United States Patent [19]

Blazevic

[11] Patent Number: 4,643,013

[45] Date of Patent: Feb. 17, 1987

[54] COIL GUIDE SYSTEM FOR HOT STRIP MILLS

[76] Inventor: David T. Blazevic, 201 Lake Dr.—Unit 1A, Olympia Fields, Ill. 60461

[21] Appl. No.: 748,483

[22] Filed: Jun. 25, 1985

[51] Int. Cl.[4] ..... B21B 39/14; B21B 43/04

[52] U.S. Cl. ..... 72/252; 198/785; 226/179; 226/199; 242/76; 72/14

[58] Field of Search ..... 72/252, 250, 14; 198/456, 785; 226/179, 195, 199; 242/76

[56] References Cited

U.S. PATENT DOCUMENTS 3,227,346 1/1966 O'Brien ..... 226/199
3,269,627 8/1966 O'Brien ..... 226/199

FOREIGN PATENT DOCUMENTS 52306 5/1981 Japan ..... 198/785

*Primary Examiner*—R. L. Spruill
*Assistant Examiner*—Steve Katz
*Attorney, Agent, or Firm*—Leydig, Voit & Mayer

[57] ABSTRACT

A first pair of generally cylindrical rollers are positioned on a run-out table. Each of the rollers has a first section including the first end of the rollers which is of a first diameter, a second section including the second end of the rollers of a second, larger diameter and a third section of changing diameter which forms a slope on the surface of the rollers joining the surfaces of the first and second sections. Each roller has its first and second ends mounted on opposite sides of the run-out table with respect to the other roller in the pair. A strip centered on the run-out table rests entirely on the smaller diameter section of the pair of rollers. The sloped sections of the rollers engage the sides of a strip as the strip veers away from the center line resisting lateral movement of the strip and cambering. The second sections support the strip when the lateral forces on it exceed the resistance provided by the adjacent sloped section and thereby tend to increase the velocity of the side of the strip supported on the second section so as to urge that side of the strip to move back toward the center line.

15 Claims, 4 Drawing Figures

COIL GUIDE SYSTEM FOR HOT STRIP MILLS

DESCRIPTION OF THE INVENTION

This invention generally relates to the handling and guiding of elongated strips of steel between a hot mill and a coiler.

The operation of a hot strip mill consists of rolling relatively wide slabs into very thin strips. In order to put these thin strips into a condition which allows for easy transport and subsequent processing, they are coiled. The rolling process is completed at the last finishing stand of the mill and the strip is thereafter conveyed on a series of rollers toward a coiler. These series of rollers are commonly known as the "run-out tables", and they include "wet" and "dry" sections. In the wet section, water sprays are used to cool the strip after it leaves the last finishing stand. The dry section follows the wet section, and in this section, the strip is allowed to become temperature equalized before it enters the coiler.

As a strip travels down the run-out tables, its movement is not restricted in any manner since any known apparatus for restricting movement of the strip may result in unacceptable damage or stopping of the strip while it is proceeding to the coiler. Therefore, the only guiding influence for the strips is the last finishing stand of the rolling mill which feeds the strip onto the tables. Consequently, the steel strips are loose and bouncing as they travel down the run-out tables. As the strips move down the run-out tables, they have a tendency to curve sideways (i.e., to camber) so that the leading ends of the strips are no longer perpendicular to the direction of travel and/or they are no longer centered on the tables.

As the leading ends of the strips travel farther down the run-out tables, (they are typically 250 to 400 feet long) it becomes increasingly difficult for the last finishing stand of the rolling mill to hold the leading ends exactly in the center of the tables. Consequently, when the leading ends reach the coiler, they are typically off center.

Because the strips enter the coiler in off-centered positions, the coiled strips have material at their inner diameters which project from the sides of the coils. This unevenness of the coil which causes the projection of material is commonplace and has come to be known in the industry as "eye telescoping". In subsequent handling and processing of the coils, the area of the eye telescoping often is damaged because it projects past the body of the coil and must be removed and discarded. Obviously, this waste of material has a significant impact on the cost of production.

Just as the leading ends of the strips enter the coiler off the center line of the run-out tables and thereby cause "eye telescoping", a similar phenomenon occurs when the trailing ends of the strips leave the run-out tables and enter the coiler. The central portions of the strips are coiled under tension since the trailing ends of the strip has not yet left the last finishing stand. Because the strip is under tension at this point, the strip is held in alignment thereby substantially eliminating any telescoping. Because the trailing ends of the strips are not under tension, the coiler alone cannot control the position of the strip; therefore, the trailing ends will also tend to move off-center. The result can be a "tail-end telescoping", and the losses in material can be even higher than those for "eye telescoping".

Severe telescoping can affect as much as 5 percent of a coil. On average, about one percent of a finished coil may be lost as scrap. For example, in a large mill that produces 300,000 tons of coils in a month, average amounts of telescoping represent an expected loss of 300,000 dollars to the mill each month, assuming the difference between final product and scrap value to be 100 dollars.

In order to reduce the amount of telescoping at the leading and trailing ends of the strips, the runout tables are equipped with a stationary guide located immediately forward of the pinch rollers of the coiler. By the time the leading ends of the strips reach the guide, they have sufficiently cooled and stabilized so as to be susceptible to lateral adjustment for centering the strips on the run-out tables before they are received by the pinch rollers of the coiler. In order to laterally adjust the position of the strips, the guide forms a channel which directs the strip to a central location on the tables.

Because of the nature of the process for forming the strip, the width of the leading end is often wider than the width of the remaining length of the strip. Moreover, the strip may be cambered or curved along its length, thereby causing the leading end to be off center and probably skewed with respect to the strip's direction of motion. Therefore, a channel defined by opposing parallel beams of the guide is opened three to five inches more than the average thickness of the strip. Although the guide in such a position reduces the amount of telescoping, the wide channel width still allows the phenomenon to persist and a substantial amount of material is still lost from the effect of telescoping.

In addition, the beams which form the guide are known to become gouged and grooved from the extreme heat of frictional contact between the beams and the edges of the strips as the edges impact into the sides of the beams at high speeds. As the beams quickly wear, the gouges become acute and may in fact cause the leading ends of the strips to jam in the grooves created in the guide.

Because the guide receives a high degree of wear in response to the impact from the moving strips and from the frictional heating of the strips engaging the sides of the beams, the beams must be taken out periodically (e.g., several times a week) and repaired or replaced. As a result, the entire rolling mill operation must be shut down in order that the guide may be repaired or replaced.

In view of the foregoing, it is a general object of the invention to provide an improved apparatus for aligning the leading and trailing edges of the steel strips as they leave the run out table and enter the coiler so that the "eye telescoping" of the coil is substantially eliminated.

It is a further object of the invention to improve the alignment of the strip on the run-out tables without requiring extensive modifications of existing equipment.

It is yet another object of the invention to provide an improved apparatus for guiding strips on the run-out tables which minimizes the heat generated by any guiding action imparted on the strip.

It is a more particular object of the invention to provide a means for guiding the strips as they travel down the run-out tables so as to urge the strip toward the center of the tables without warping or otherwise deforming the strips. In this connection, it also an object of the invention to provide an improved apparatus which complements the guiding action of the parallel beams which form the stationary guide.

Other objects and advantages of the invention will become apparent upon reading the following detailed description and upon reference to the drawings, in which.

Figure 2:
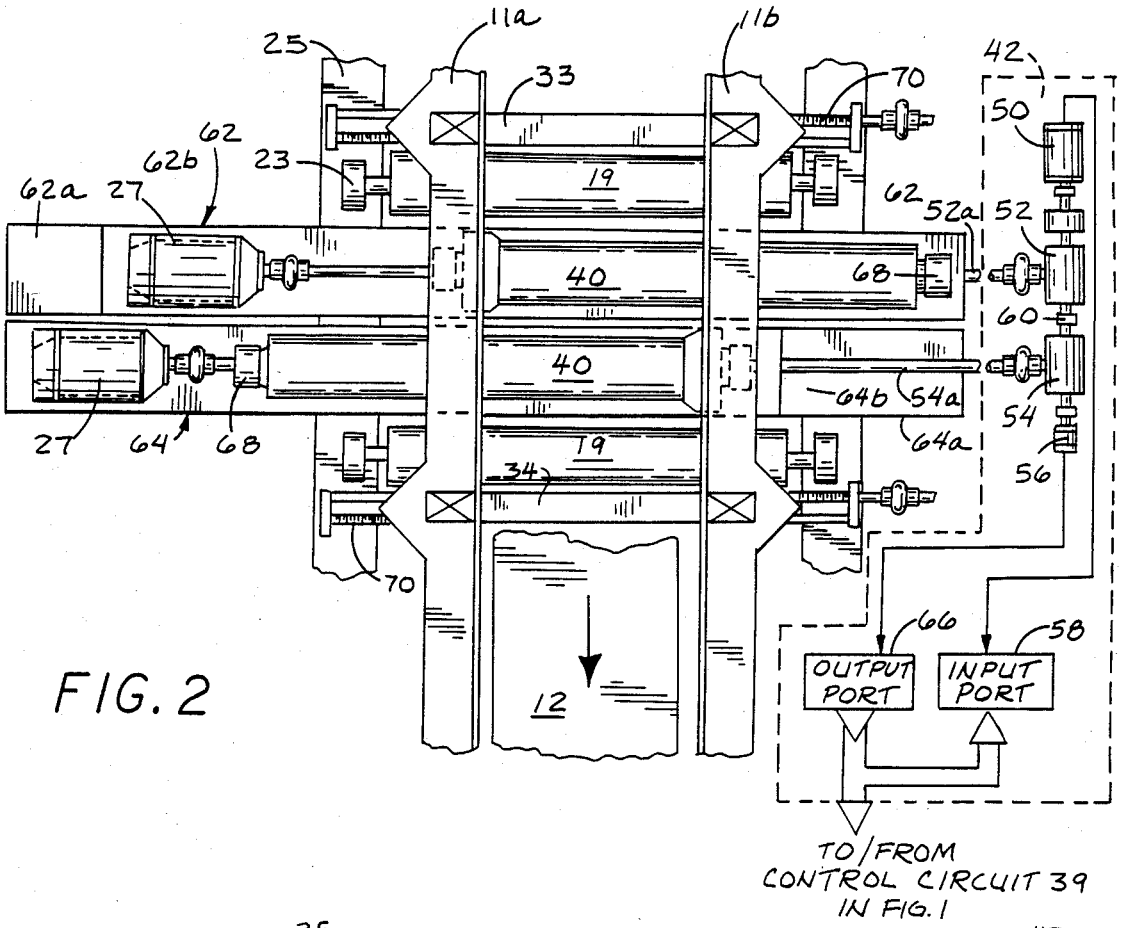
FIG. 2 is an enlarged plan view of a pair of alignment rollers according to the invention mounted on one section of the run-out tables in the area of the channel formed by the parallel beams of the guide.
Figure 3:
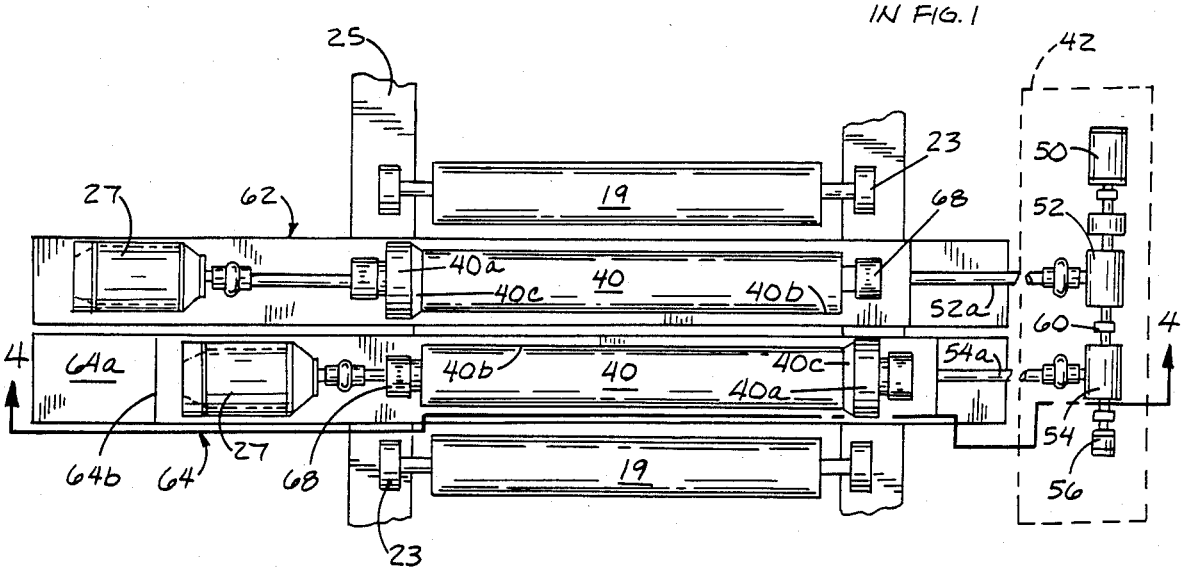
Figure 4:
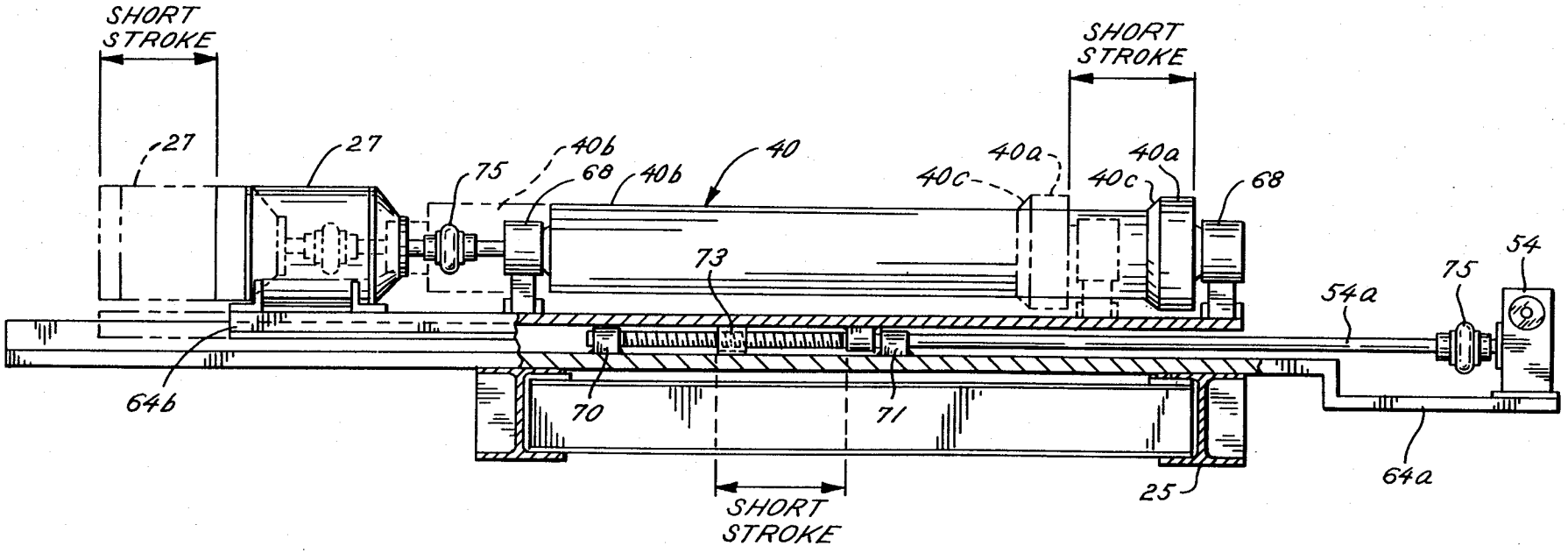

FIG. 3 is a plan view of the pair of alignment rollers of FIG. 2 shown in their withdrawn position and with the parallel beams of the stationary guide removed in order to more clearly show the details of the alignment rollers according to the invention; and FIG. 4 is a side view of one of the alignment rollers in FIG. 3 taken partly in section along the line 4—4 in order to show the mechanism for providing longitudinal movement of the rollers.

While the invention will be described in connection with a preferred embodiment, it will be understood that it is not intended to limit the invention to a particular embodiment. On the contrary, it is intended to cover all alternatives and equivalents as may be included within the spirit and scope of the invention.

Figure 1:
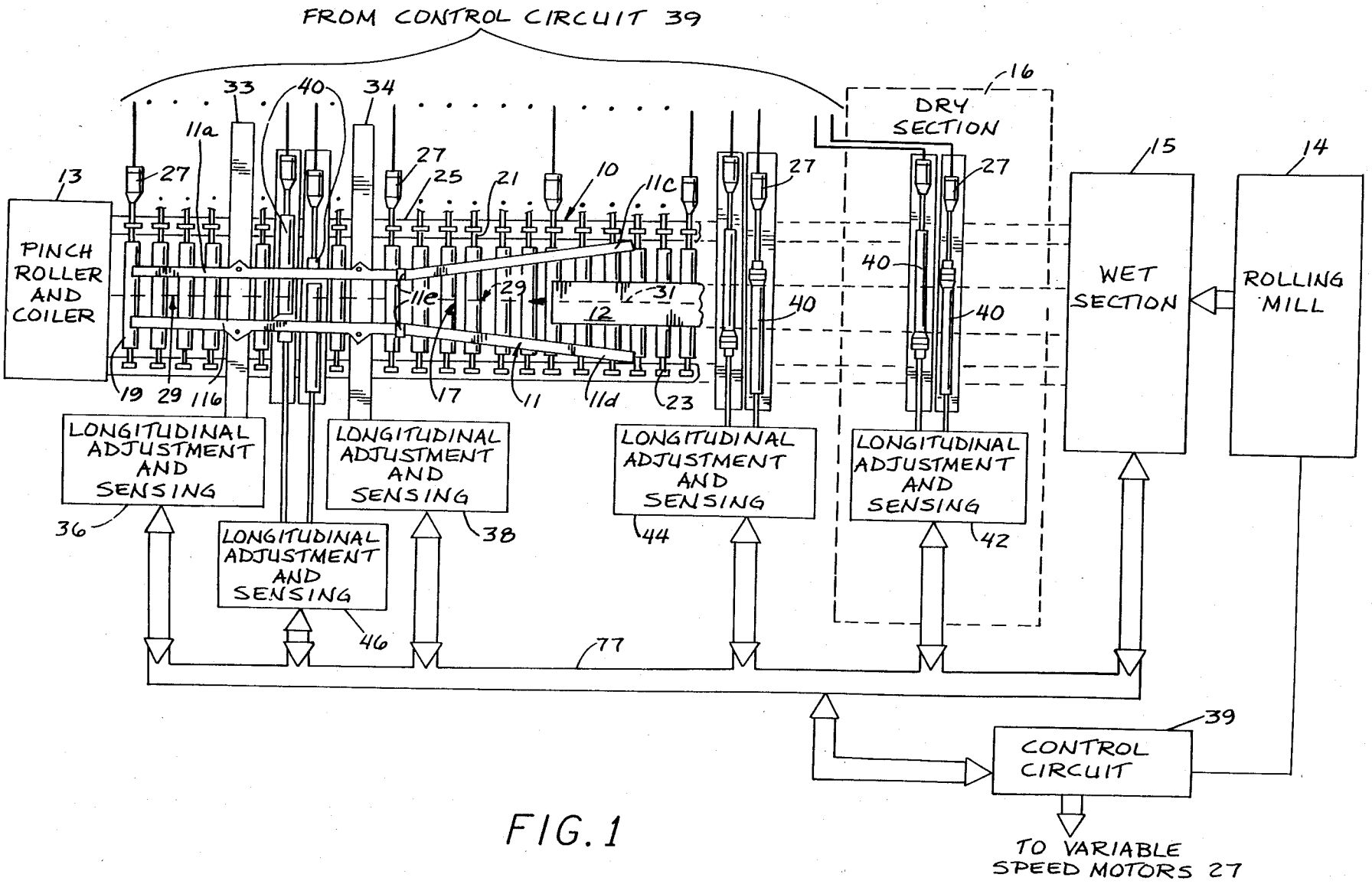
FIG. 1 is a plan view, partially in schematic, of the run-out tables and coiler for rolling thin strips of metal made from larger slabs wherein the run-out tables include pairs of alignment rollers in accordance with the invention for aligning the thin strips on the tables as they are directed to a coiler.

Referring more particularly to FIG. 1 of the drawings, in hot strip mills, a series of aligned run-out tables 10 receive elongated strips 12 of hot steel as they are drawn from a rolling mill 14. A wet section 15 of run-out tables 10 first quenches the steel with water, then the temperature of the steel is permitted to equalize in a dry section 16 before it is directed, by way of a finishing section 17, into a pinch roller and coiler assembly 13 where it is rolled into coils. The finishing section 17 of the run-out table 10 includes a stationary guide, generally designated as 11, which serves to aid in aligning the strips 12 on the tables before the strips enter the pinch roller of the coiler assembly 13.

The run-out tables 10 include a series of hollow rollers 19 with each roller having an axial shaft 21 that includes journals at each end received by bearings 23 which permit free rotation of the rollers about their longitudinal axes. The rollers 19 are supported on an assembly frame 25 which in turn is bolted to foundation beams (not shown). The longitudinal axes of the rollers 19 are generally aligned in a parallel arrangement, and the rollers are preferably spaced at equal intervals along the length of the run-out tables 10. Each of the rollers 19 is rotated by a variable speed motor 27 coupled to one end of the axial shaft 21 of the roller. By rotating the rollers 19 such that their surface velocity is substantially the same as the velocity of the strip 12, the frictional wear of the rollers by the strips 12 is substantially reduced. In addition, the driven rotation of the rollers 19 aids in moving the strip along the run-out tables 10.

In a conventional manner, the stationary guide 11 is mounted on the assembly frame 25 in the finishing section 17 of the run-out table 10 for urging the center line 31 of the strip 12 to align with the center line 29 of the run-out tables 10. The guide 11 comprises a pair of straight beams **11*a* and 11*b* set parallel to the center line 29 of the run-out tables 10 and a pair of opposing straight beams 11*c* and 11*d* which are positioned so as to form a funnel leading to the channel formed from the pair of parallel beams 11*a* and 11*b*. These beams 11*a*–11*d* cooperate to guide the strip along its path on the run-out tables 10 such that the center line 31 of the strip is maintained close to the center line 29** of the run-out tables, thereby helping to keep the leading edge of the strip perpendicular to the strip's direction of motion.

The rightmost end of each beam **11*c* and 11*d* as viewed in FIG. 1 is fixedly secured to the assembly frame 25 of the run-out tables 10. Each of the beam pairs 11*a*, 11*c* and 11*b*, 11*d* is joined by a hinge 11*e* so as to form a continuous wall for guiding one side of the strip 12. The parallel beam sections 11*a* and 11*b* of the guide 11 are mounted on rails 33 and 34 which cooperate to move the parallel beam sections toward or away from one another in order to narrow or widen the channel formed by the beams. In order that the beams 11*a* and 11*b* can slide on the rails 33 and 34, longitudinal adjustment and sensing means 36 and 38 control movement of the guide on the rails 33 and 34. A control circuit 39 communicates with the longitudinal adjustment and sensing means 36 and 38 by way of bi-directional bus 77 for adjusting the width of the channel formed by the guide. Since the guide 11 and the longitudinal adjustment and sensing means 36 and 38** are well known in the industry, their structure and operation will not be dealt with in detail except where necessary for understanding the invention.

Because of the variable width and possible camber (curvature) of the strips 12 and because of the excessive heat buildup from direct contact between the strips and the beams of the guide 11, the channel formed by the parallel beams **11*a* and 11*b* of the stationary guide 11 must be kept at a width somewhat greater than the nominal width of the strips 12 in order to prevent pinching or jamming of the strip 12 in the channel. As a result of the foregoing requirements for the width of the channel, the center 31 of the strip 12 may still move substantially away from the center line 29 of the run-out tables 10. Therefore, the stationary guide 11** may reduce the severity of eye telescoping, but it is not a totally satisfactory answer to the problem.

Because the extra width of the leading end of a strip 12 requires additional width to be added to the channel of the guide 11, a method called "short stroke" has been developed whereby the width of the channel formed by the guide is maneuvered to reduce the channel width after the leading end has passed through the channel, thereby more tightly guiding the main body of the strip. In the short stroke method, the channel formed by the parallel beams **11*a* and 11*b* of the guide 11 is held by the longitudinal adjustment and sensing means 36 and 38 at an initial width that is sufficiently wide to receive the leading end of the strip 12 without risk of jamming. After the leading end has passed through the channel and into the coiler 13, the beams 11*a* and 11*b* of the guide 11 are moved inwardly on the rails 33 and 34 by the longitudinal adjustment and sensing means 36 and 38 through a "short stroke" so as to closely guide the narrower portion of the strip 12** which follows the leading end.

In order to execute the short stroke method, the control circuit 39 receives data from the rolling mill 14 which enables the control circuit in a well-known manner to synchronize generation of command signals to the longitudinal adjustment and sensing means 36 and 38 so that the channel is moved to a more narrow width after the leading end of a strip 12 has passed through the channel. In addition to controlling the "short stroke" movement of the guide 11, the control circuit 39 controls the rotational speed of the rollers 19 by providing control signals to the variable speed motors 27, as is also well known in the art.

In accordance with the invention, rollers 40 having a dual diameter, and a sloped area of substantially constant gradient connecting the areas of differing diameter, provide means for centering the strips 12 on the run-out tables 10. The rollers 40 of the invention are arranged in pairs and they are mounted on the run-out tables 10 such that their rotational axes are parallel to the rotational axes of the rollers 19. In a pair of rollers 40 according to the invention, one roller is mounted on the run-out tables 10 so as to have its larger diameter portion 40*a* located on one side of the tables whereas the adjacent, second roller in the pair is mounted on the table so its larger diameter portion is located on the opposite side of the tables as best seen in FIG. 3. With the larger diameter portions 40*a* of a pair of rollers according to the invention located on opposing sides of the run-out tables 10, the smaller diameter sections 40*b* overlap in the direction of strip movement so as to form a channel having side walls of the sloped area 40*c* joining the two sections 40*a* and 40*b*. The smaller diameter portions 40*b* of the rollers of the invention are those portions of the rollers over which the strip 12 is intended to travel. With the larger diameter portions 40*a* mounted on opposite sides of the run-out tables 10, they cooperate with the sloped area 40*c* to provide a centering influence on the strips 12 without pinching the strip as it travels over the run-out tables 10.

In keeping with the invention, if a strip 12 is off-center on the run-out tables 10, one side of the strip is either riding on the larger diameter surface 40*a* of one of the roller pairs of the invention or its edge is biased against the sloped area 40*c* of one of the rollers. In the case where the strip 12 is riding on the larger diameter portion 40*a* of the roller, that side of the strip will tend to travel at a higher rate of speed than the other side of the strip because the angular velocity of the surface of the roller at its larger diameter is greater than the angular velocity of the surface of the smaller diameter portion 40*b* on which the opposing side of the strip is riding. As a result of this differential in velocities, the strip 12 is directed back toward the center 29 of the run-out tables 10. In a particular example, if the section 40*b* of smaller diameter is 12 inches and the section 40*a* of larger diameter is 14 inches, then the surface speed of the section of larger diameter will be 17 percent greater than the surface speed of the section of smaller diameter.

The dual-diameter rollers 40 of the invention do not constrain the movement of the strips 12 as does the guide 11; instead, the rollers first resist lateral movement of the strips 12 away from the center line 29 of the run-out tables 10 by engaging the side of the strips along the sloped sections of 40*c* the rollers which tends to resist further lateral movement of the strip, thereby inhibiting cambering of the strip along its length. If the lateral force of the strip 12 overcomes the resistance provided by the sloped section 40*c* of one of the rollers, then one side of the strip climbs up the slope and onto the larger diameter section 40*a* of the roller and thereby causes that side of the strip to travel at a higher velocity than the opposing side of the strip. As a result of this higher velocity on one side of the strip 12, the strip tends to move away from the side of higher velocity and back toward the center line 29 of the tables 10.

Because each pair of rollers according to the invention applies a force transverse to the strip's direction of motion without physically blocking lateral movement of the strip, there is no danger that the strip may be jammed or pinched as it tends to be in the area between the parallel beams of the guide 11. Because the smaller diameter section 40*b* of the dual-diameter roller is spinning at about the same speed of the strip 12, the wear of the roller is minimized. As for the wear on the area of the roller 40 having an increased diameter, the difference in velocities between the small and large diameters is insufficient to produce significant wear.

In keeping with the invention and as best seen in FIGS. 1 and 2, a pair of the dual-diameter rollers 40 according to the invention are mounted on the assembly frame 25 underneath the guide 11 in order to more precisely align the leading edge of the strip 12 on the finishing section 17 so as to virtually eliminate the problem of eye telescoping. In order to reduce the wear of the beams 11*c* and 11*d* of the guide 11—whose function is to funnel the strips 12 into the channel—it is preferred to position a second pair of the dual-diameter rollers 40 upstream from the guide 11. In addition, it may be desirable to include a third pair of opposing dual-diameter rollers 40 at locations within the wet or dry sections 15 or 16, respectively, of the run-out tables 10 to further inhibit cambering of the strip. Finally, pairs of opposing dual-diameter rollers 40 according to the invention may be placed throughout the length of the run-out tables 10 to the extent that they will further aid in centering the strips 12.

In order to adjust the relative positions for each pair of dual-diameter rollers 40, longitudinal adjustment and sensing means 42, 44 and 46 as seen in FIG. 1 receive control signals from the control circuit 39. By providing for longitudinal movement of the dual-diameter rollers 40, the width of the channel formed by the smaller diameter section 40*b* of a roller pair may be adjusted to match the nominal width of different strips 12. The same type of control signals used to control the transverse movement of the beams 11*a* and 11*b* of the guide 11 may be used to control the position of the dual-diameter rollers 40.

A particular mechanism for implementing the longitudinal adjustment and sensing means 42 includes a step motor 50, right-angle transmissions 52 and 54 and rotation sensor 56 as best seen in FIG. 2. Command signals are delivered to the step motor 50 from the control circuit 39 by way of the bi-directional bus 77 and the input port 58. Rotational shafts intercouple the step motor 50, the transmissions 52 and 54 and the rotation sensor 56. In order to protect each device, the intercouplings include conventional shock absorbing devices generally indicated at 60. In response to rotation of the step motor 50, the output shafts 52*a* and 54*a* of the transmissions 52 and 54, respectively, rotate and thereby impart longitudinal movement to the platforms 62 and 64 which support the pair of rollers 40. Exact longitudinal placement of the platforms 62 and 64 is achieved by providing a feedback signal to the control circuit 39 from the rotation sensor 56 by way of an output port 66 and the bi-directional bus 77.

Because both bearing supports 68 of each roller 40 are mounted on platforms 62 or 64, each roller moves with its associated platform. In addition, the variable speed motor 27 for each of the rollers 40 is also mounted on the platform 62 or 64. Preferably, the dual-diameter rollers 40 are of a similar construction as that of the rollers 19, e.g., hollow and formed of centrifugally cast steel tubes which may be overlayed with 420 chrome if desired. As with the rollers 19, the rollers of the invention are dynamically balanced in order to lengthen their useable life. Driven rotation of the rollers 40 is accomplished by extending the shafts of the variable speed motors 27 so that they are coupled to the rollers along their rotational axes. Lateral adjustment of the beams 11*a* and 11*b* of the guide 11 on the rails 33 and 34 is accomplished by threaded shafts 70 in a manner well known in the art.

As the leading edge of a strip 12 leaves the rolling mill 14, the pairs of dual-diameter rollers 40 upstream from the pair associated with the guide 11 are preferably in a fully withdrawn position as shown in FIG. 3 such that the larger diameter sections 40*a* of the pair are moved to a lateral position coincident with the ends of the rollers 19. After the leading end of the strip 12 has passed the pair of dual-diameter rollers 40, each of the rollers is moved inwardly as indicated by the phantom lines in FIG. 4 in order that the smaller diameter sections 40*b* of the pair of rollers 40 define a channel width equal to the nominal width of the strip 12. The foregoing "short stroke" of the dual-diameter rollers 40 allows the larger diameter sections 40*a* and the sloped sections 40*c* to engage the sides of the strip 12, if it is off-centered, and work to urge the strip into a central location on the run-out tables 10. By successfully reducing the degree of misalignment prior to the strip reaching the guide 11, the beams 11*a* and 11*b* will not undergo the rapid wear previously experienced in mills without the roller pairs of the invention.

The mechanism for transforming the rotational movement of the shafts 52*a* and 54*a*, driven by the right-angle transmission 52 and 54, respectively to longitudinal movement of the rollers 40, can best be seen by reference to FIG. 4. Each of the platforms 62 and 64 are composed of upper and lower sections. Inasmuch as only platform 64 is shown in FIG. 4, only that platform will be described in detail. But it will be appreciated that platform 62 is essentially of the same construction.

The lower section 64*a* of platform 64 is secured to the frame assembly 25 and provides a rail for securing and guiding upper section 64*b*. The shaft 54*a* is received within a gap separating the upper and lower sections 64*a* and 64*b*, respectively, of the platform 64. The shaft 54*a* is journaled to two blocks 70 and 71 secured to the lower section 64*a*. A threaded section of the shaft 54*a* is received by a threaded bore 73 secured to the lower surface of the upper platform 64*b*. Rotation of the shaft 54*a* causes the threaded bore 73 to move along the threaded portion of the shaft, thereby transforming the rotational motion of the shaft to linear motion which longitudinally moves the roller pairs 40. It will be appreciated that in order for platforms 62 and 64 to move equal distances but in opposite directions in response to rotation of the motor 50 either the shafts 52*a* and 54*a* must turn in opposite directions or the threads of the shafts and their threaded bores must be in opposing directions.

Because the rollers 19 and 40 experience substantial vibration as the strips 12 travel over them, couplings 75 joining the shaft of the variable motor 27 and the shaft of the roller 40 protect the motor from damage. Similarly, a coupling 75 also joins the shaft 54*a* and the right-angle transmission 54 in order to protect the transmission from possible damage from vibrations.

From the foregoing, it will be appreciated that an improved apparatus and method for aligning strips on the run-out tables is provided which can be inexpensively and easily installed in existing tables by simply replacing standard rollers 19 with roller pairs 40. In order to provide longitudinal movement for the pairs, mechanisms of a similar type used to control the channel width of the guide 11 may be used. Although an electro-mechanical system has been disclosed for controlling longitudinal movement of the rollers 40, other well-known control systems such as pneumatic or hydraulic systems may also be used.

I claim:

1. An apparatus for guiding elongated steel strips over a series of rollers mounted on a table, said apparatus comprising:

at least first and second pairs of dual-diameter rollers in said series of rollers wherein each roller is mounted on said table in a position that is reversed with respect to the position of the other dual-diameter roller in the pair, each dual-diameter roller being mounted for rotation about its longitudinal axis for guiding the elongated steel strips along the center of the table;

a first section of each dual-diameter roller having a first diameter for supporting the strips when they are centered on the table;

a second section of each dual-diameter roller adjacent said first section and having a gradient formed by a diameter which changes along the longitudinal axis of the roller so as to form a sloped surface on each of said dual-diameter rollers such that each of said first and second pairs of dual-diameter rollers form a channel in the strip's direction of motion, whereby the side edges of said elongated steel strips engage the sloped surface when the leading ends of said strips wander from a central position on said table so as to inhibit, but not prevent, cambering of the strip and movement of the strip to an off-centered position and to redirect the leading end of the strip to a centered position on said table;

a pair of parallel beams mounted to said table at its downstream end and over a said first pair of dual-diameter rollers so as to form a channel that guides said strips toward the center of said table; and said second pair of dual-diameter rollers located upstream of said pair of parallel beams and each of said rollers in at least said second pair including a third section of a second diameter greater than the first diameter of said first section, each of said third sections supporting sides of said elongated strips that have climbed over an associated second section of a dual-diameter roller, thereby causing the faster surface velocity of each of said third sections to urge the sides of the strip resting on the third sections to move at a faster velocity than the opposite sides of the strips resting on said first sections so as to direct the strips back toward the center of said table.

2. An apparatus as set forth in claim 1 wherein each roller in said pairs of rollers is mounted on a slidable platform which moves said roller along its longitudinal axis in order to adjust the width of said channel.

3. An apparatus as set forth in claim 2 including means for moving the platforms for said second pair of dual-diameter rollers mounted thereon between first and second positions in response to the passage of the leading end of a strip over the second pair of rollers such that the first position defines a channel substantially wider than the nominal width of said strip and said second position defines a width approximately equal to the nominal width of said strip.

4. An apparatus as set forth in claim 3 wherein said moving means includes a control circuit for synchronizing the movement of the strips over the run-out table with movement of the platforms such that said second pair of rollers assumes said second position only after the leading end of said strip has passed downstream of said second pair of rollers.

5. An apparatus as set forth in claim 1 wherein said first pair of dual-diameter rollers are positioned to form a channel having a width approximately equal to the nominal width of said elongated steel strips and said pair of parallel beams form a channel having a width slightly wider than the nominal width of said strips, whereby wear of the pair of parallel beams is minimized by said first pair of dual-diameter rollers acting to center the leading end of the strip in the channel formed by said pair of parallel beams.

6. An apparatus as set forth in claim 1 wherein said second pair of dual-diameter rollers is separated from the upstream end of said pair of parallel beams by at least one constant-diameter roller.

7. An apparatus as set forth in claim 6 including means for moving said second pair of dual-diameter rollers from first to second positions in response to passage of the leading edges of said strips to the downstream side of said second pair, wherein said first position forms a channel width greater than said second position and said second position has a width approximately equal to the nominal width of said strips.

8. In a hot rolling mill for forming elongated strips of steel, a series of cylindrically-shaped rollers forming a run-out table for cooling and stabilizing the strips before they are coiled wherein a pair of parallel beams are mounted over the rollers at the downstream end of said run-out table for centering said strips on the table, an apparatus for guiding the strip along the center of the run-out table before the leading ends of said strips reach said pair of parallel beams, said apparatus comprising a first pair of dual-diameter, cylindrical rollers positioned on said run-out table upstream of said pair of parallel beams and separated from the upstream end of said pair of parallel beams by at least one cylindrically-shaped roller and mounted to span the two sides of said table wherein each of said rollers has a first section including the first end of the rollers which is of a first diameter, a second section including the second end of the rollers of a second, larger diameter and a third section of changing diameter which forms a slope on the surface of the roller joining the surfaces of said first and second sections; said pair of rollers being mounted on said run-out tables with their axes of rotation position generally transverse to the direction of motion of said strip and with each roller having its first and second ends mounted on opposing sides of said run-out table with respect to the other roller in the pair such that in the direction of motion for the strip the first sections of the rollers overlap along their axes of rotation for a distance equal to or greater than the width of said strip with the center line of the run-out table bisecting the width of said overlap so that strip centered on the run-out table rests entirely on the smaller diameter sections of the pair of rollers; said sloped sections engaging the sides of said strip if the head end of said strip veers away from said center line and thereby resisting lateral movement of the head end of said strip and cambering along the length of the strip; and one of said second sections of larger diameter supporting the strip when the lateral forces on the strip have exceeded the resistance provided by the adjacent sloped section and thereby tending to increase the velocity of the side of the strip supported on one of said second sections so as to urge the side of the strip resting on the large diameter section to move back toward said center line.

9. An apparatus as set forth in claim 8 wherein said first pair of rollers are mounted on slidable platforms for moving said rollers along their longitudinal axis in order to adjust the width of said channel and means are coupled to said platforms for moving said rollers equal distances in opposite directions.

10. An apparatus as set forth in claim 8 wherein said pair of parallel beams are mounted directly over a second pair of dual-diameter, cylindrical rollers.

11. An apparatus as set forth in claim 9 including means for moving said platforms and the rollers mounted thereon between first and second positions in response to the passage of the leading end of a strip over the rollers such that the first position defines a channel substantially wider than the nominal width of said strip and said second position defines a width approximately equal to the nominal width of said strip.

12. An apparatus as set forth in claim 11 wherein said moving means includes a control circuit for synchronizing the movement of the strip over the run-out table with movement of the platforms such that said pair of rollers assumes said second position only after the leading end of said strip has passed downstream of said pair of rollers.

13. A method of reducing cambering and off-centered alignment of elongated strips delivered from a mill onto a run-out table comprising a series of rollers and a pair of parallel guides over a portion of said series of rollers for centering said strips on said table, said method reducing eye and tail-end telescoping and comprising the steps of:

(1) positioning upstream from said pair of parallel guides at least one pair of dual-diameter rollers on said run-out table, said pair of dual-diameter rollers cooperating to form a channel in the direction of motion of said strips which accepts the width of said strips when they are centered on said table;

(2) resisting lateral movement of the strips in the channel but yielding to lateral movement of the strips before damaging the strips; and (3) urging those portions of the strips outside the channel to travel at a faster velocity than those portions inside the channel so as to direct the strip back into the channel.

14. A method as set forth in claim 13 including the step of changing the width of the channel formed by said at least one pair of dual-diameter rollers from a first width which accepts the leading end of said strips to a second, lesser width which approximates the nominal width of said strips, said changing responsive to the passage of the leading end over said at least one pair of dual-diameter rollers and independent of any movement of said pair of parallel guides.

15. A method as set forth in claim 14 wherein each of said rollers in said pair is comprised of two sections of different diameters joined by a gradient section of changing diameter.

* * * * *

UNITED STATES PATENT AND TRADEMARK OFFICE

CERTIFICATE OF CORRECTION

PATENT NO. : 4,643,013

DATED : February 17, 1987

INVENTOR(S) : David T. Blazevic

It is certified that error appears in the above-identified patent and that said Letters Patent is hereby corrected as shown below:

On line 29 in column 2 "thickness" has been changed to --width--.

Signed and Sealed this

Fifteenth Day of December, 1987

*Attest:*

DONALD J. QUIGG

*Attesting Officer*

*Commissioner of Patents and Trademarks*